US010174469B2

(12) United States Patent
Julien

(10) Patent No.: US 10,174,469 B2
(45) Date of Patent: Jan. 8, 2019

(54) ACCESSORY FOR POSITIONING AND RECOVERING TRAFFIC CONES

(71) Applicant: MATI INDUSTRIES & TECHNOLOGIES, Saint Andiol (FR)

(72) Inventor: Félix Julien, Mazan (FR)

(73) Assignee: MATI INDUSTRIES & TECHNOLOGIES, Saint Andiol (FR)

( * ) Notice: Subject to any disclaimer, the term of this patent is extended or adjusted under 35 U.S.C. 154(b) by 0 days.

(21) Appl. No.: 15/106,449

(22) PCT Filed: Dec. 17, 2014

(86) PCT No.: PCT/FR2014/053378

§ 371 (c)(1),
(2) Date: Jun. 20, 2016

(87) PCT Pub. No.: WO2015/092266

PCT Pub. Date: Jun. 25, 2015

(65) Prior Publication Data

US 2016/0333537 A1 Nov. 17, 2016

(30) Foreign Application Priority Data

Dec. 18, 2013 (FR) ..... 13 62871

(51) Int. Cl.
*A61G 3/06* (2006.01)
*E01F 9/70* (2016.01)

(52) U.S. Cl.
CPC ..... *E01F 9/70* (2016.02)

(58) Field of Classification Search
CPC ..... A61G 3/06; A61G 3/062
USPC ..... 414/501, 502, 509, 525.1, 541
See application file for complete search history.

(56) References Cited

U.S. PATENT DOCUMENTS 5,651,657 A * 7/1997 Poindexter ..... B60P 1/00 187/222
2009/0097914 A1* 4/2009 Flynn ..... E01F 9/70 404/9

FOREIGN PATENT DOCUMENTS

EP 0501106 A1 9/1992
EP 1630294 A1 3/2006
EP 2405059 A1 1/2012
(Continued)

OTHER PUBLICATIONS

International Search Report dated Mar. 23, 2015 in corresponding Application No. PCT/FR2014/053378; 2 pgs.

*Primary Examiner* — Saul Rodriguez
*Assistant Examiner* — Willie Berry, Jr.
(74) *Attorney, Agent, or Firm* — Maier & Maier, PLLC

(57) ABSTRACT

A device for handling traffic cones that may equip a vehicle, including a frame, a mechanism for transferring the cones from a provisioning unit to a handling station, a cone gripping unit, and mechanism for moving the gripping unit between the handling station and release points. The moving mechanism includes a lifting unit ensuring vertical movement for raising and lowering the gripping unit, a translation unit ensuring the transverse horizontal movement of the lifting unit and the gripping unit, the translation unit includes at least one first slider that includes a fixed part rigidly connected to the frame and a part that can move in translation, a second slider that includes a part rigidly connected to the movable part of the first slider and a second part that can move in translation.

2 Claims, 3 Drawing Sheets

(56) References Cited

FOREIGN PATENT DOCUMENTS

| | | | |
|---|---|---|---|
| WO | 2006/048680 | A1 | 5/2006 |
| WO | 2013068716 | A1 | 5/2013 |

* cited by examiner

ACCESSORY FOR POSITIONING AND RECOVERING TRAFFIC CONES

TECHNICAL FIELD OF THE INVENTION

The invention has for object a device for handling traffic cones that can be installed in a vehicle, for the automatic positioning and/or recovering of these traffic cones.

It relates to the technical field of devices for handling and more particularly that of automatic devices.

PRIOR ART

Manually positioning or recovering traffic cones can be slow and above all dangerous for the operator. By leaning out of or by getting off of the vehicle, the operator is often at a very short distance from moving vehicles and as such risks causing an accident that places his life or that of other persons in danger.

Several inventions have attempted to overcome this problem by proposing various devices, manual or automatic, that make it possible to avoid the intervention of an operator as much as possible. Some of the devices proposed have an articulated arm allowing for the positioning of traffic cones but do not always make it possible to recover them, which then requires the use of a separate system.

The system proposes in document WO 2013 068716 (YEARWOOD CLEBERT O'BRYAN RICARDO) makes it possible to position and recover traffic cones thanks to an articulated arm coupled to the vehicle and having 6 axes of movement. The system is controlled by data supplied by a GPS device that makes it possible to retain a constant distance in the position of the cones. However, this system, coupled to the vehicle, is very complex and the installation of the vehicle is long and difficult. In addition, as this system is of substantial size, it can be installed only at the rear of a utility vehicle that is of a sufficient size. This can have negative effects during the use of the system on roads of limited size or on roads that are overloaded with traffic, such as for example the main motorways.

The invention aims to replace this state of affairs. In particular, an objective of the invention is to obtain a simplified device that is smaller and able to adapt to any type of vehicle.

Another objective of the invention is to facilitate the installation of the device in order to make it possible to easily vary the vehicles wherein the latter is used.

DIVULGATION OF THE INVENTION

The solution proposed by the invention is a device for handling traffic cones that may equip a vehicle, said device comprises:

- a frame,
- a means for transferring cones from a provisioning unit to a handling station,
- a cone gripping unit,
- and means for moving said gripping unit between the handling station and release points.

This device is remarkable in that the means for moving comprise:

- a lifting unit ensuring vertical movement for raising and lowering the gripping unit,
- a translation unit ensuring the transverse horizontal movement of said lifting unit and of said gripping unit, said translation unit comprising at least one first slider that comprises a fixed part rigidly connected to the frame and a part that can move in translation, a second slider that comprises a part rigidly connected to the movable part of the first slider and a second part that can move in translation, that is in the form of a carriage, said lifting unit comprising a vertical guide rigidly connected to the carriage and to said gripping unit.

This device has means for moving traffic cones having only two axes of movement. This particularity allows for the manufacturing of a simplified device, which as such makes it possible to reduce manufacturing and installation costs. In addition, this makes it possible to reduce the size of the device and as such facilitate its installation and allow for its use in vehicles of modest size. The decrease in the price makes it possible to equip a larger number of vehicles and therefore facilitate a simultaneous and faster positioning or recovering of cones over several release points at a time.

Advantageous characteristics of the device for handling are listed hereinbelow. Each one of these characteristics can be considered individually or in combination with the remarkable characteristics defined hereinabove, said remarkable characteristics are not indispensable as such for the resolution of the technical problems that the characteristics hereinbelow are proposed to resolve:

- the means for transferring between the provisioning unit and the handling station can have the form of a plate driven by a longitudinal movement,
- the gripping unit can have the form of a cradle comprising a system of clamps located on the top part of the cradle, and an anti-tipping guiding system located on the bottom part of the cradle.

A second aspect of the invention is a vehicle quipped with a device for handling traffic cones comprising:

- a frame installed on the chassis of said vehicle thanks to means of fastening,
- a provisioning unit of traffic cones,
- a means for transferring cones from the provisioning unit to a handling station,
- a cone gripping unit,
- and means for moving said gripping unit between the handling station located inside said vehicle and release points located outside said vehicle.

This vehicle is remarkable in that the means for moving comprise:

- a lifting unit ensuring vertical movement for raising and lowering the gripping unit,
- a translation unit ensuring the transverse horizontal movement of said lifting unit and of said gripping unit, said translation unit comprising at least one first slider that comprises a fixed part rigidly connected to the frame and a part that can move in translation, a second slider parallel to the first slider, said second slider comprises a part rigidly connected to the movable part of the first slider and a second part that can move in translation, that is in the form of a carriage, said lifting unit comprising a vertical guide rigidly connected to the carriage and to said gripping unit.

Advantageous characteristics of the device for handling are listed hereinbelow. Each one of these characteristics can be considered individually or in combination with the remarkable characteristics defined hereinabove, said remarkable characteristics are not indispensable as such for the resolution of the technical problems that the characteristics hereinbelow are proposed to resolve:

- a version of this vehicle can have a device that has its own source of electrical energy in order to operate its various units, said source of energy is autonomous and independent of the one that makes it possible to operate said vehicle.

another version of this vehicle can have the provisioning unit that is located in the vicinity of the handling station, said vehicle being provided with a means for transferring making it possible to transport the traffic cones from the provisioning unit to the handling station during a method of positioning, and from the handling station to the provisioning unit during a method of recovering, said means for transferring having the form of a plate driven by a longitudinal movement that moves between the provisioning unit and the handling station, yet another version of the vehicle can have a control unit that controls the moving of said device, said control unit is connected to a GPS device is such a way that the controlling of said device is according to the speed of movement of the vehicle and that the cones are positioned at regular distance intervals, a version of the vehicle can have a control unit, said control unit that controls the movement of the device, is connected to a camera and a screen in such a way that the methods of positioning or recovering the traffic cones can be carried out during a movement in reverse, another version of the vehicle can have a control unit that controls the movement of the device, said control unit is connected to a system for measuring the distance between the gripping unit and the cones, said control unit integrating a computer program of which the instructions make it possible to control the gripping unit according to the distance measured, yet another version of the vehicle can comprise a control unit that has its own source of electrical energy, which is autonomous and independent of that making it possible to operate said vehicle Yet another aspect of the invention relates to a method for the positioning of traffic cones using the aforementioned device and comprising the steps consisting in:

Supplying the handling station,

Grasping the traffic cone by means of the gripping unit,

Transversally moving by means of the translation unit said cone outside the vehicle then vertically by means of the lifting unit on release point, Dropping the cone on the release point, Raising the gripping unit then bringing it to the handling station before resupplying it.

An additional aspect of the invention relates to a method for recovering traffic cones using the aforementioned device and comprising the steps consisting in:

Grasping the traffic cone on the release point by means of the gripping unit,

Raising the traffic cone vertically by means of the lifting unit then moving it transversally by means of the translation unit to the handling station, Dropping the cone on the handling station, Raising the gripping unit then bringing outside the vehicle on following traffic cone, Clearing the handling station.

DESCRIPTION OF THE FIGURES

Other advantages and characteristics of the invention shall appear better when reading the following description of a preferred embodiment, in reference to the annexed drawings, carried out as not limiting examples for the purposes of information and wherein.

PREFERRED EMBODIMENTS OF THE INVENTION

Figure 1:
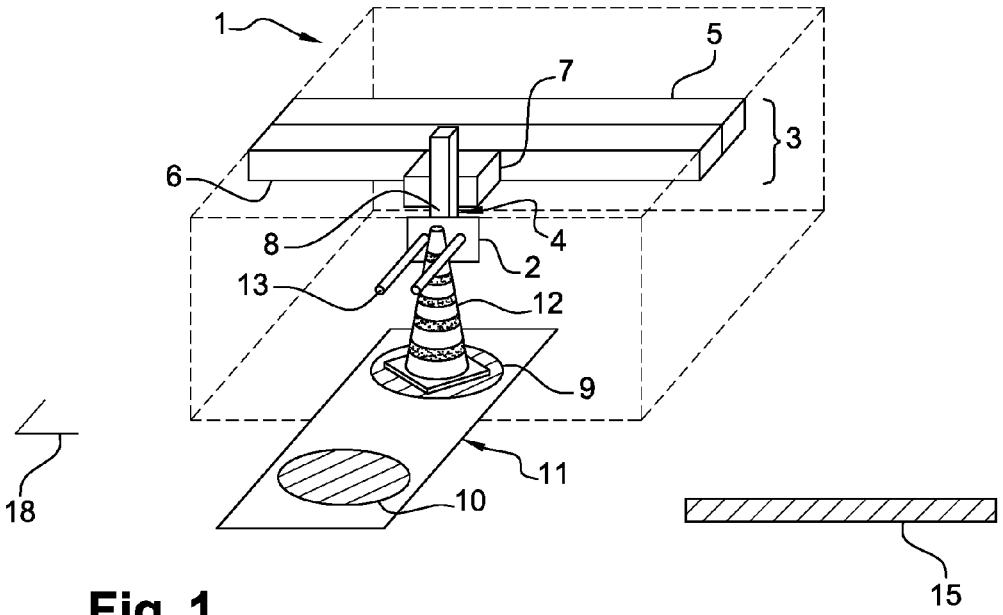
FIG. 1 is a diagrammatical view of one of the preferred embodiments of the device for handling, object of the invention.

The device for handling object of the invention is used for the positioning and the recovering of traffic cones (12) on the road surface (15), after its installation in an adapted vehicle such as a truck, a van, a trailer or any other utility vehicle. The traffic cones (12) make it possible among other things, to delimit a zone at risk during an accident or to mark off a works zone. They can as such be useful on road surfaces (15) such as motorways or smaller roads such as national or departmental roads.

When it is used, the device can be provided with a control unit that makes it possible to control it. This control unit is connected to a device that records the speed of the vehicle. This device can be a GPS device, a speed regulator or any other system that makes it possible to record the speed of movement of the vehicle. The controlling of the device for handling is then controlled by the speed of movement which as such makes it possible to maintain a constant inter-cone distance. The regular positioning of the cones improves the safety of the users and of the operators when large zones must be marked off.

During the installation, the control unit described hereinabove can be connected to a camera and to a control screen. The vision of traffic cones (12) is then improved and allows for an easier use of the device during methods of positioning or of recovering in reverse.

The control unit can also be connected to a system that makes it possible, during the recovering of the cones (12), to measure the distance between the gripping unit (2) and said cones. This system is an automatic aid in positioning for the gripping unit (2) and will allow for a better detection of the cones (12) and as such release points (15). This aid can, for example, have the form of an optical pointing of the trajectory that must be used for an effective recovery of the cones (12). It can also consist in a device that makes it possible to adjust the position of the gripping unit (2) according to the distance measured between the latter and the cones (12). In this latter embodiment, the control unit, thanks to a computer program that makes it possible to control the gripping unit (2) according to the distance measured, will allow for an easier and faster recovery.

The control unit can be connected electrically to the vehicle or can have its own source of electrical energy that is independent such as for example a battery, solar panels, an autonomous inverter, or a pneumatic system.

Figure 2:
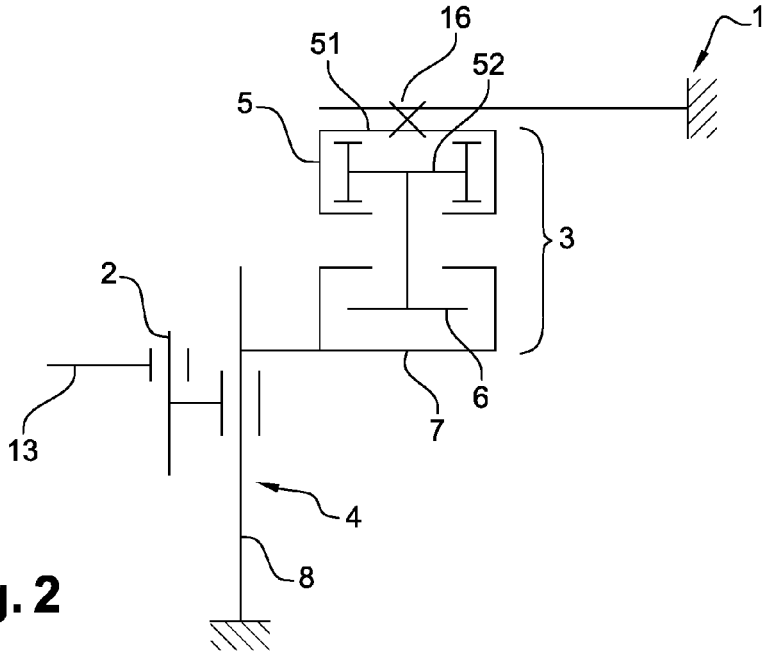
FIG. 2 is a functional diagram of the device for handling according to FIG. 1.

FIGS. 1 and 2 show one of the preferred embodiments of the device for handling according to the invention. They show a device comprised of a frame (1) that is fastened onto the chosen vehicle. This frame (1) makes it possible to secure the device for handling inside the vehicle. It can for example have the form of a frame installed temporarily in the vehicle and which is fastened onto the chassis using removable means for attaching such as screws or bolts. This armature can have the form of bars made of metal, plastic or other rigid material. The frame (1) can be of variable size ranging from 600 mm to 3 m and can either be installed directly on the vehicle, or by the intermediary of a system of rails that makes it possible to move it inside the vehicle.

The frame (1) makes it possible to install the device for handling in such a way that it can be used either for a positioning of the cones (12) on the right of the vehicle, or for a positioning on the left. In an embodiment, the device is installed in such a way that the cones (12) can be positioned on both sides of the vehicle. This device for handling is installed on the frame (1) by the intermediary of a translation unit (3).

As the device does not make it possible to accumulate cones (12) on the handling station (9), it is necessary that is comprises a provisioning unit (10) as well as a means for transferring (11) between said provisioning unit (10) and the handling station (9). This means for transferring (11) can be a plate driven by a longitudinal movement going from the provisioning unit (10) to the handling station (9). It can also have the form of a slider provided with a gripping unit.

The provisioning unit (10) can have the form of a stack of cones (12) from which or to which an operator manually transfers the cones (12). This operation can also be carried out automatically by using for example a conveyor belt or a device of the carrousel type whereon the cones (12) are positioned in succession. A mechanism of the unstacker type can also be used to carry out this transfer.

Once the cone (12) is placed on the handling station (9), it is grasped by a gripping unit (2) then moved between the handling station (9) and release points (15) located on the road surface. These means for moving consist in a lifting unit (4) and a translation unit (3).

Figure 5:
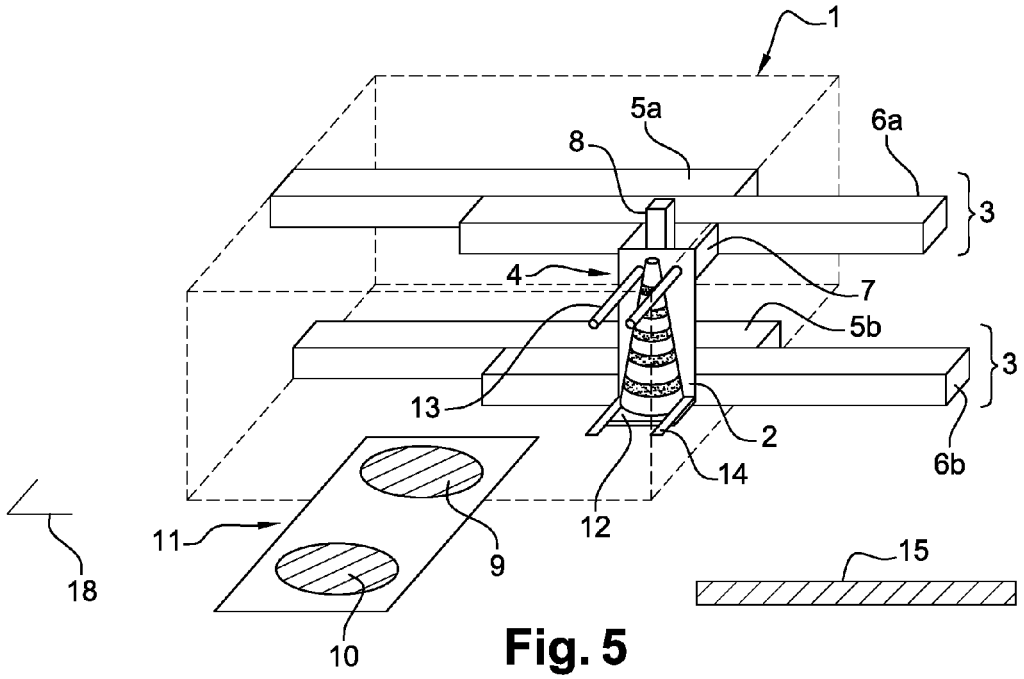
FIG. 5 is a diagrammatical view of one of the steps of the methods of positioning or recovering traffic cones.

As shown in FIG. 5, the translation unit (3) makes it possible to move the lifting unit (4) whereon is fastened the gripping unit (2). It carries out a movement from the inside to the outside of the vehicle for the positioning of the cones (12) or from the outside to the inside of the vehicle for the recovery of the cones (12).

In FIGS. 1 and 2, the gripping unit (2) making it possible to grasp and drop the traffic cone (12), is comprised of clamps (13) that grasp the top of said cone. However, it is not limited to this embodiment. For example, in FIGS. 3 and 4, it has the form of a cradle comprised of a system of clamps (13) on its upper part and an anti-tipping guiding system (14) on its lower part. The top of the cone (12) is therefore grasped by the system of clamps (13) while the bottom is supported by the guiding system (14) that slides immediately on top of the base of said cone. This configuration makes it possible to maintain the base of the cone (12) parallel to the road surface (15) and as such prevent it from tipping during the positioning of it.

The translation unit (3) is a means that makes it possible to horizontally move the gripping unit (2). In FIGS. 1 and 2, it is comprised of a system comprised of two sliders (5, 6).

A first slider (5), rigidly connected to the frame (1) has a length between 150 cm and 3 m and is formed in a material such as steel, aluminum or any other rigid material. It is fastened horizontally on the frame using means for attaching such as screws or bolts, in such a way as to be parallel to the plane (18) formed by the chassis of the vehicle.

A fixed part (51) of the slider (5) is fastened to the frame (1) by means for attaching (16) such as screws, hooks, or any other technique known to those skilled in the art. A movable part (52) allows for a horizontal translation of the gripping unit (2) and can have the form of a sliding valve, of a roller, or of a carriage.

The movable part (52) can be motorized, for example by means of a mechanism of the gearwheel/rack type. The gearwheel rigidly connected to the movable part (52) is combined with an electric motor that provides for setting it into rotation in one direction or the other, and the rack is rigidly connected to the fixed part (51). The movable part (52) can also be motorized by means of a mechanism of the endless screw/nut type, wherein said endless screw is rigidly connected to the fixed part (51).

A second slider (6) is fastened onto the movable part (52) of this first slider (5) using means for attaching that are similar to those defined hereinabove. This second slider (6) is comprised of a first part rigidly connected to the movable part (52) of the first slider (5), and of a second movable part (7) having the form of a carriage and making it possible to carry out a horizontal translation movement.

The movable part (7) of the second slider (6) can be motorized using means similar to those described beforehand. It is fastened so as to be parallel to the first slider (5). In a manner similar as for the first slider (5), it has a length between 150 cm and 3 m and is formed in a rigid material such as steel, aluminum or plastic. The length of the sliders depends on the size of the vehicle used. They can be chosen so as to enter into said vehicle but can also have the form of retractable sliders that allow them to be adapted to any type of vehicle.

In FIGS. 1 and 2, the translation unit (3) is comprised of a single system with two sliders and makes it possible to obtain an ultra-simplified device comprising a gripping unit (2) comprised solely of clamps (13) in order to grasp the top of the traffic cone (12). This embodiment allows for the manufacturing of a device that is very inexpensive and particularly suited for vehicles of modest size such as for example a van.

Figure 3:
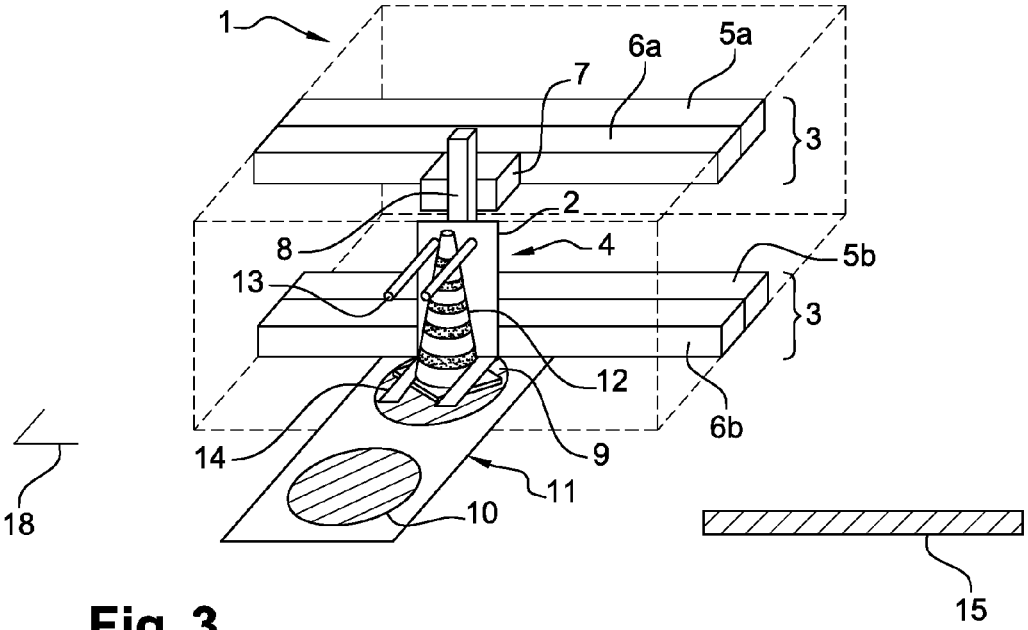
FIG. 3 is a diagrammatical view of another preferred embodiment of the device for handling, object of the invention.
Figure 4:
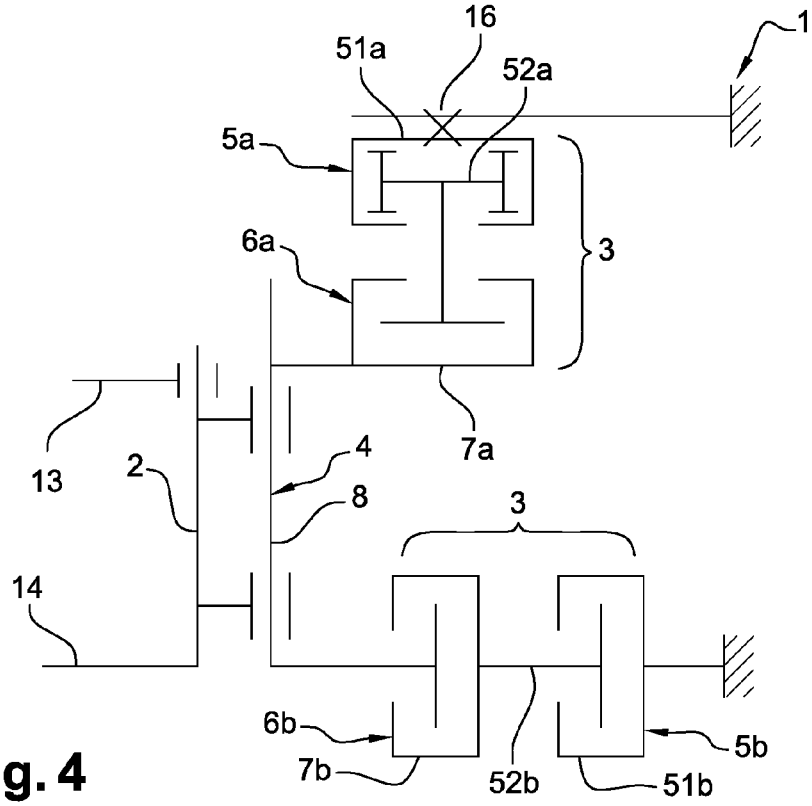
FIG. 4 is a functional diagram of the device for handling according to FIG. 3.

FIGS. 3 and 4 show a translation unit (3) which is composed of two translation systems each comprised of two sliders (5*a*, 6*a* and 5*b*, 6*b*). This mode makes it possible to use the gripping unit (2) in the form of a cradle described previously, and as such to obtain a better positioning of the cones (12) by preventing the latter from tipping on the road surface.

The embodiments are not limited to those described in the figures. For example, the gripping unit (2) in the form of a cradle shown in FIGS. 3 and 4 can, in the same way, be installed on the translation unit (3) comprised of a single slider and shown in FIGS. 1 and 2.

Two first sliders (5*a*, 5*b*), rigidly connected to the frame (1) have a length between 150 cm and 3 m and are formed in a material such as steel, aluminum or any other rigid material. Their fixed parts (51*a*, 51*b*) are fastened horizontally on the frame (1) using means for attaching such as screws or bolts, in such a way as to be parallel to one another as well as to the plane (18) formed by the chassis of the vehicle.

The movable parts (52*a*, 52*b*) of the sliders (5*a*, 5*b*) allow for a horizontal translation of the gripping unit (2) and can have the form of sliding valves, of rollers, or of carriages. These movable parts (52*a*, 52*b*) can be motorized, for example by means of a mechanism of the gearwheel/rack type. The gearwheel rigidly connected to the movable parts (52*a*, 52*b*) is combined with an electric motor that provides for the setting of it into rotation in one direction or in the other direction. The rack is rigidly connected to the fixed parts (51*a*, 51*b*). The movable parts (52*a*, 52*b*) can also be motorized by means of a mechanism of the endless screw/nut type, wherein said endless screw are rigidly connected to the fixed parts (51*a*, 51*b*).

Two second sliders (6*a*, 6*b*) are fastened onto the movable parts (52*a*, 52*b*) of the first sliders (5*a*, 5*b*) using means for attaching that are similar to those defined hereinabove. These second sliders (6*a*, 6*b*) are comprised of parts rigidly connected to the movable parts (52*a*, 52*b*) of the first sliders (5*a*, 5*b*), and of movable parts (7*a*, 7*b*) having the form of carriages and making it possible to carry out a horizontal translation movement.

These movable parts (7*a*, 7*b*) can be motorized by means of mechanisms similar to those described hereinabove. They are attached respectively, to the clamps (13) and to the anti-tipping guiding system (14) of the gripping unit (2) and are fastened in such a way as to be parallel to the first sliders (5*a*, 5*b*). In a manner similar as for the first sliders (5*a*, 5*b*), they have a length between 150 cm and 3 m and are formed in a rigid material such as steel, aluminum or plastic.

As the translation unit (3) allows for a horizontal transfer of the cones (12), it is necessary to have a means that carries out a vertical translation movement of the gripping unit. Indeed, once the cone (12) has left the vehicle via the translation unit (3), it must be possible to lower it as close as possible to the road surface (15). In the same way, during the recovery of cones (12), it is necessary to be able to lower the gripping unit (2) on cone (12) in such a way that the latter grasps it. A lifting unit (4) is therefore attached to the translation unit (3) and is comprised of a vertical guide (8) whereon the gripping unit (2) is installed.

Figure 6:
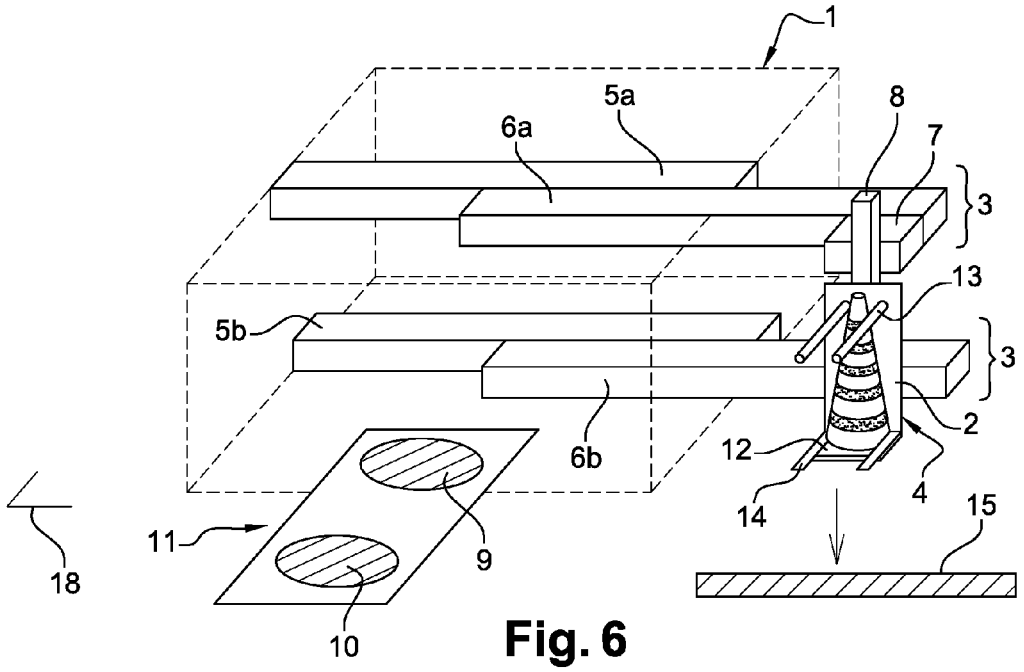
FIG. 6 is a diagrammatical view of one of the steps of the methods of positioning or recovering traffic cones.

In FIG. 6, the cone (12) is grasped by the gripping unit (2). It is then raised by the lifting unit (4) during the positioning, or lowered during the recovering. The lifting unit (4) makes it possible in a first step to bring the gripping unit (2) close to the road surface (15) but also to raise it before returning it to the inside of the vehicle.

The vertical guide (8) that comprises the lifting unit (4), is rigidly connected to the carriage (7) of the second slider (6). It is manufactured in a material similar to the one used for the sliders (5, 6) and has a length between 50 cm and 300 cm according to the height of the vehicle used. It is connected to the carriage (7) thanks to means for attaching similar to those described hereinabove and can have the form of a slider wherein a movable part connected to the gripping unit (2) is located. This movable part is able in the same way as hereinabove, to have the form of a carriage or of a sliding valve.

The movable parts (52, 7) of the sliders (5, 6) of the translation unit (3), as well as the lifting (4), gripping (2) and provisioning (10) units can be connected to a source of electrical energy. It can entail a connection of the device on the vehicle used. The device can also have its own electrical source which will be autonomous and independent of that used to operate the vehicle, such as for example a battery, solar panels, an autonomous inverter, or a pneumatic system.

The arrangements of the various elements and/or means and/or steps of the invention, in the embodiments described hereinabove, must not be understood as requiring such an arrangement in all of the implementations. In any case, it shall be understood that various modifications can be made to these elements and/or means and/or steps, without leaving the idea and the scope of the invention. In particular:

- the type of vehicle,
- the means for attaching the frame (1) onto the chassis of the vehicle,
- the means for attaching between the various sliders (5, 6),
- the means for attaching sliders (5, 6) onto the frame (1),
- the number of systems with two sliders (5, 6) forming the translation unit (3),
- the materials used for manufacturing the various units,
- the type of electrical source to operate the motorized parts.

The invention claimed is:

1. Device for handling traffic cones configured to equip a vehicle, said device comprises:

- a frame,
- a mechanism for transferring cones between a provisioning unit and a handling station,
- a cone gripping unit,
- and mechanism for moving said cone gripping unit between the handling station and release points,
- said provisioning unit, said handling station and said cone gripping unit being located inside the vehicle, and said release points being located outside the vehicle, on a road surface,
- said mechanism for moving comprising
- a lifting unit ensuring vertical movement for raising and lowering the gripping unit,
- a translation unit ensuring the transverse horizontal movement of said lifting unit and of said cone gripping unit, and
- wherein,
- said translation unit comprises at least one first slider that comprises a fixed part rigidly connected to the frame and a movable part configured to move in horizontal translation, a second slider that comprises a part rigidly connected to the movable part of the first slider and a second movable part that can move in horizontal translation, that is in the form of a movable carriage,
- said lifting unit comprising a vertical guide rigidly connected to the movable carriage and to said cone gripping unit
- said cone gripping unit having the form of a cradle comprising a system of clamps located on the top part of the cradle, and an anti-tipping guiding system located on the bottom part of the cradle.

2. Device for handling traffic cones according to claim 1, wherein said mechanism for transferring between a provisioning unit and the handling station has the form of a plate driven by a longitudinal movement that is moved between the provisioning unit and the handling station.

* * * * *